US005671627A

United States Patent [19]

Lisciani

[11] Patent Number: 5,671,627

[45] Date of Patent: Sep. 30, 1997

[54] WIRE-DRAWING MACHINE FOR DRY-LUBRICATED METAL WIRE

[75] Inventor: Giulio Lisciani, Grottammare, Italy

[73] Assignee: R. Lisciani Trafilerie e Divisione Dyn Automazione Industriale S.n.c., Grottammare, Italy

[21] Appl. No.: 622,020

[22] Filed: Mar. 26, 1996

[30] Foreign Application Priority Data

Mar. 28, 1995 [EP] European Pat. Off. ..... 95830114

[51] Int. Cl.[6] ..... B21B 45/02

[52] U.S. Cl. ..... 72/43; 72/41

[58] Field of Search ..... 72/41, 43, 44; 366/165.1; 156/51

[56] References Cited

U.S. PATENT DOCUMENTS 3,664,169 5/1972 Henrich ..... 72/278

FOREIGN PATENT DOCUMENTS 0 504 846 A1 9/1992 European Pat. Off. .
A-95 216 1/1973 German Dem. Rep. .
167 087 1/1906 Germany .
C-167 087 1/1906 Germany .
A-19 46 221 4/1971 Germany .
19 46 221 4/1971 Germany .
95 216 1/1973 Germany .
WO 89/07006 8/1989 WIPO ..... 366/165.1

OTHER PUBLICATIONS

European Search Report, dated Aug. 22, 1995, of EP 95 83 0114.
EPO Form 1503.

*Primary Examiner*—Lowell A. Larson
*Assistant Examiner*—Rodney Butler
*Attorney, Agent, or Firm*—Finnegan, Henderson, Farabow, Garrett & Dunner, L.L.P.

[57] ABSTRACT

Wire-drawing machine for metal wire with dry lubrication, comprising a tool-carrying device provided with:

a tubular body having a cavity for containing and fixing a die, extending from an entry end to an exit end for the metal wire inside the tubular body;

a support for the tubular body on which the latter is coaxially mounted in a rotatable manner so as to rotate upon operation of associated actuator means, said support being provided with a fluid cooling chamber for the die;

a container for powdery lubricant arranged above the support and connected to the tubular body so as to rotate about the metal die, imparting to the powdery lubricant a helical movement towards the die, thereby lubricating the metal wire before it enters the die.

18 Claims, 3 Drawing Sheets

IV
IV
28
23
26
19
12a
25
21
22
22
18
17
10
4
8
12b
20
24
24
27
35
34
36
37

WIRE-DRAWING MACHINE FOR DRY-LUBRICATED METAL WIRE

BACKGROUND OF THE INVENTION

The present invention relates to a wire-drawing machine for dry-lubricated metal wire, comprising a rotating tool-carrying device provided with:

- tubular body having a cavity for containing and fixing at least one die, extending from an entry end to an exit end for the metal wire inside the tubular body;
- a support for the tubular body, on which the tubular body is rotatably mounted so as to rotate upon operation of associated actuator means so as to cause rotation of the die, rendering uniform the wear thereof caused by the metal wire, said support for the tubular body being provided with a fluid cooling chamber for the die;
- a container for powdery lubricant associated with the support for the tubular body so as to lubricate the metal wire prior to its entry into the die.

Wire-drawing machines of the type described above are already known, one of which is illustrated in a prior patent application filed in Italy by the same Applicant.

As is known, wire-drawing machines comprise a series of drawing stations, arranged in a line, through which the wire is gradually reduced in cross-section.

Each wire-drawing machine is provided with one or more tool-carrying devices associated with a container for powdery lubricant, which is statically fixed to the structure of the wire-drawing machine and through which the wire passes so as to allow lubricant to adhere to it.

Normally the container is completely closed, has a substantially parallelepiped shape, extending mainly horizontally, and has mounted on it the die support in horizontal alignment, downstream of the container, in the direction of movement of the wire along the wire-drawing machine.

The container is provided internally with a mechanical stirrer, the purpose of which is that of producing in the lubricant a turbulence which, also favoured by the high volatility of the lubricant itself, allows the lubricant already used for processing in the die to be continually remixed with the unused lubricant present in large quantities in the container. This makes it possible to avoid a reduction in the drawing efficiency which would otherwise occur if the said lubricant were to remain constantly at the entry point of the die.

Such a tool-carrying device has large overall dimensions and a significant structural complexity which makes its use justifiable only in the case of high-power wire-drawing machines, characterized by high ratios of dimensional reduction of the end product compared to the semi-finished starting product.

BRIEF SUMMARY OF THE INVENTION

The object of the present invention is that of providing a wire-drawing machine which has a simple structure, is low cost and has small dimensions, as a result of which it is possible to obtain, with a drawing efficiency comparable to that obtained with the already known tool-carrying devices, constructional solutions which are economically more advantageous, in particular in the case of low-power drawing such as that which is required for the manufacture of thin wires which are obtained from semi-finished products with slightly larger dimensions.

For this purpose, the wire-drawing machine according to the present invention is provided with a tool-carrying device which supports the lubricant container above the die support, in conditions such that it is constrained with the tubular body contained therein and provided with a rotational movement about the wire. As a result of this combined arrangement, the powdery lubricant descends by means of gravity towards the underlying die and, also in combination with a stationary stirrer immersed in the lubricant itself, at the same time acquires a rotational movement due to the entraining movement imparted to it by the rotating container. This produces a general helical movement of the powdery lubricant towards the die, which is designed to produce thorough and orderly remixing of the lubricant itself.

The container is preferably symmetrically formed with respect to the wire and can be inserted into the tubular body so as to be easily removable and allow both maximum access to the die for checking and/or replacing the latter and maximum ease of operation should the wire accidentally break and have to be threaded into the die again.

The container is moreover made up of parts which can be assembled with one another so that it can easily be removed or reassembled on the sleeve even with the wire inserted inside the die.

A further advantageous feature of the tool-carrying device is also provided by the fact that, owing to the extreme uniformity of movement of the lubricant inside the container, the construction of the latter can be simplified such that it is possible to provide a constantly open loading section which enables the lubricant inside the container to be easily checked and replenished.

Moreover, owing to the position of the container above the die-carrier, it is possible, in particular in the case of wire-drawing machines with few drawing stages, to provide vertically extending support structures which have small dimensions in plan view and in which a plurality of devices are mounted on top of one another, with alignment of the respective containers and supports.

In order to facilitate still further access to the die carrier, in particular in wire-drawing machines with a vertical structure, the wire-drawing machines according to the invention are provided with special fixing brackets provided with rapid locking and release means which enable the tool-carrying device to be removably fixed to the structure of the wire-drawing machine. This allows the entire tool-carrying device to be removed from the wire-drawing machine so that the die can be easily accessed, if necessary with rethreading of the wire, in conditions of maximum ease for the personnel responsible for checking the operation of the wire-drawing machine.

These supports are also provided with ducts for supplying the cooling fluid to the dies, the attachment sections of which are positioned so that connection of the ducts supplying fluid to the die cooling chamber is performed automatically, by means of the same single operation which enables the tool-carrying device to be mounted in the working position on the support.

BRIEF DESCRIPTION OF THE DRAWINGS

Further advantages and features of the invention will emerge more clearly from the following detailed description, with reference to the accompanying drawings, which illustrate an embodiment thereof purely by way of an non-limiting example, in which.

DESCRIPTION OF THE PREFERRED EMBODIMENTS

Figure 1:
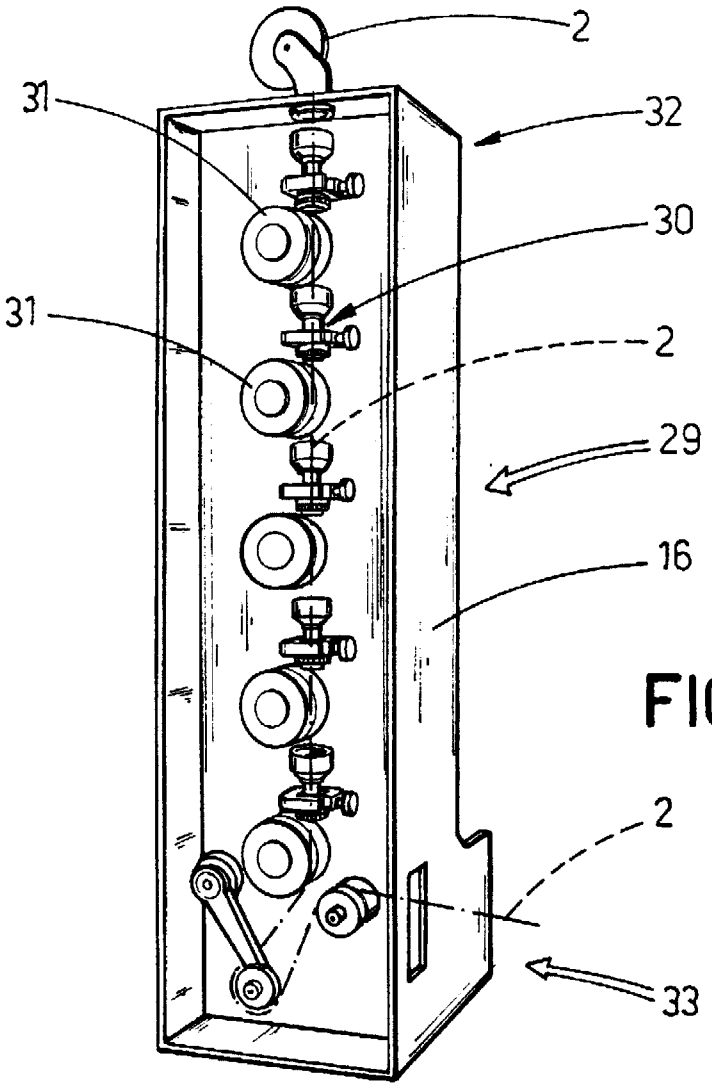
FIG. 1 shows an overall front perspective view of a wire-drawing machine according to the invention.
Figure 2:
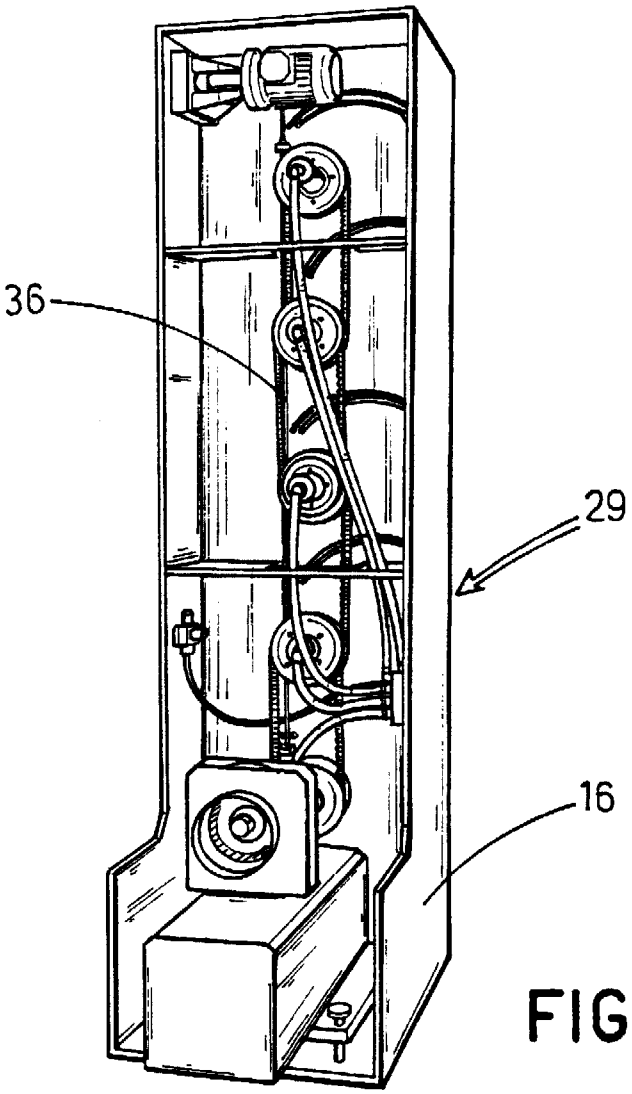
FIG. 2 shows an overall rear perspective view of the wire-drawing machine according to FIG. 1.

With reference to the accompanying FIG. 1, it can noted that the invention substantially consists in a wire-drawing machine (29) for metal wire (2) with dry lubrication.

The wire-drawing machine (29) has a vertical structure (16) with vertically aligned drawing sections (30) through which the metal wire (2) coming from the top (32) of the wire-drawing machine (29) undergoes a gradual reduction in its cross-section until it emerges from the wire-drawing machine (29) in the region of its base (33).

More particularly, each drawing section (30) comprises a capstan (31) which is conventionally motorized and on which the metal wire (2) is collected in turns which are unwound and rewound tangentially when passing from the capstan (31) itself to that of a following section (30).

Between each pair of capstans (31), the wire-drawing machine (29) is provided with a tool-carrying device (1) which substantially comprises (FIG. 4) a tubular body (4), coaxially mounted on a support (8) for the body (4), and a container (10) for powdery lubricant, said body and container being vertically aligned.

The tubular body (4) has a cavity (7) extending from an entry end (5) and an exit end (6) for the metal wire (2), suitable for containing and fixing preferably two dies (3) aligned along the metal wire (2) and arranged as a continuation of one another.

The support (8) for the tubular body (4) rotatably supports the tubular body (4) itself so as to allow the latter to rotate upon operation of associated actuator means (9) so as to cause rotation of the die (3), rendering uniform the wear caused by rubbing of the metal wire (2) during processing.

The actuator means (9) are of the conventional type and preferably comprise a pair of toothed wheels (33, 34), the driven wheel (33) of which is mechanically connected to the tubular body (4), while the driving wheel (34) receives the movement from a flexible belt transmission (35) driven by a motorized shaft (36).

Figure 4:
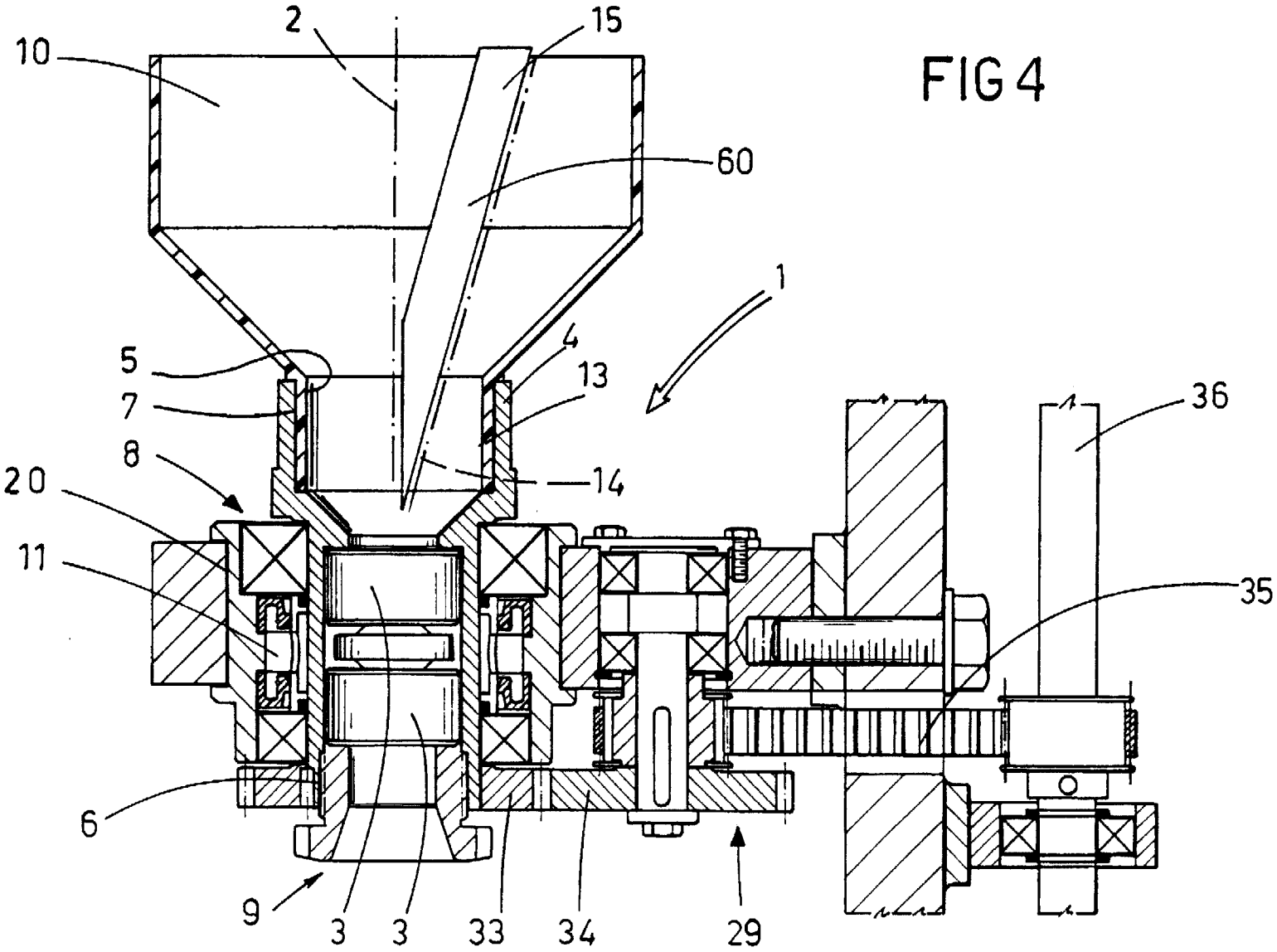
FIG. 4 shows a view of the detail of the invention according to FIG. 3, shown on a larger scale and sectioned along the line IV—IV of FIG. 3.

As can be seen from FIG. 4, the support (8) for the tubular body (4) is provided with a fluid cooling chamber (11) which surrounds the tubular body (4) so as to cool the dies (3) contained therein.

The container (10) for powdery lubricant is associated with the support (8) for the tubular body (4) so as to lubricate the metal wire (4) before it enters the die (3).

More particularly, the lubricant container (10) contains a stationary stirrer (6) fixed to the wire-drawing machine (29) and immersed in the lubricant. Said container (10) is moreover arranged above the support (8) for the tubular body (4) and is connected to the latter so as to rotate together therewith about the metal wire (2), imparting to the powdery lubricant contained therein, in conjunction with the stirrer (60), a helical movement towards the die (3).

Preferably the container (10) has the form of a shaped solid of revolution, constituting a frustoconical cup, which is symmetrical with respect to the metal wire (2). Moreover it can be movably associated with the tubular body (4) and, for this purpose, has a shaped end (13) for engagement in a corresponding cavity (14) of the tubular body (4) which is shaped in a complementary manner. Finally it is constructed as two identical parts (12*a*, 12*b*) which can be assembled with one another so that together they form between them an overall cup-shaped container (10) which can be advantageously associated with the tubular body (4) even when the metal wire (2) is inserted in the die (3).

In its upper part, the container (10) has a section (15) for loading the lubricant, open and located at the top, which enables the lubricant to be inspected easily and to be replenished rapidly whenever necessary.

Figures 3, 3A:
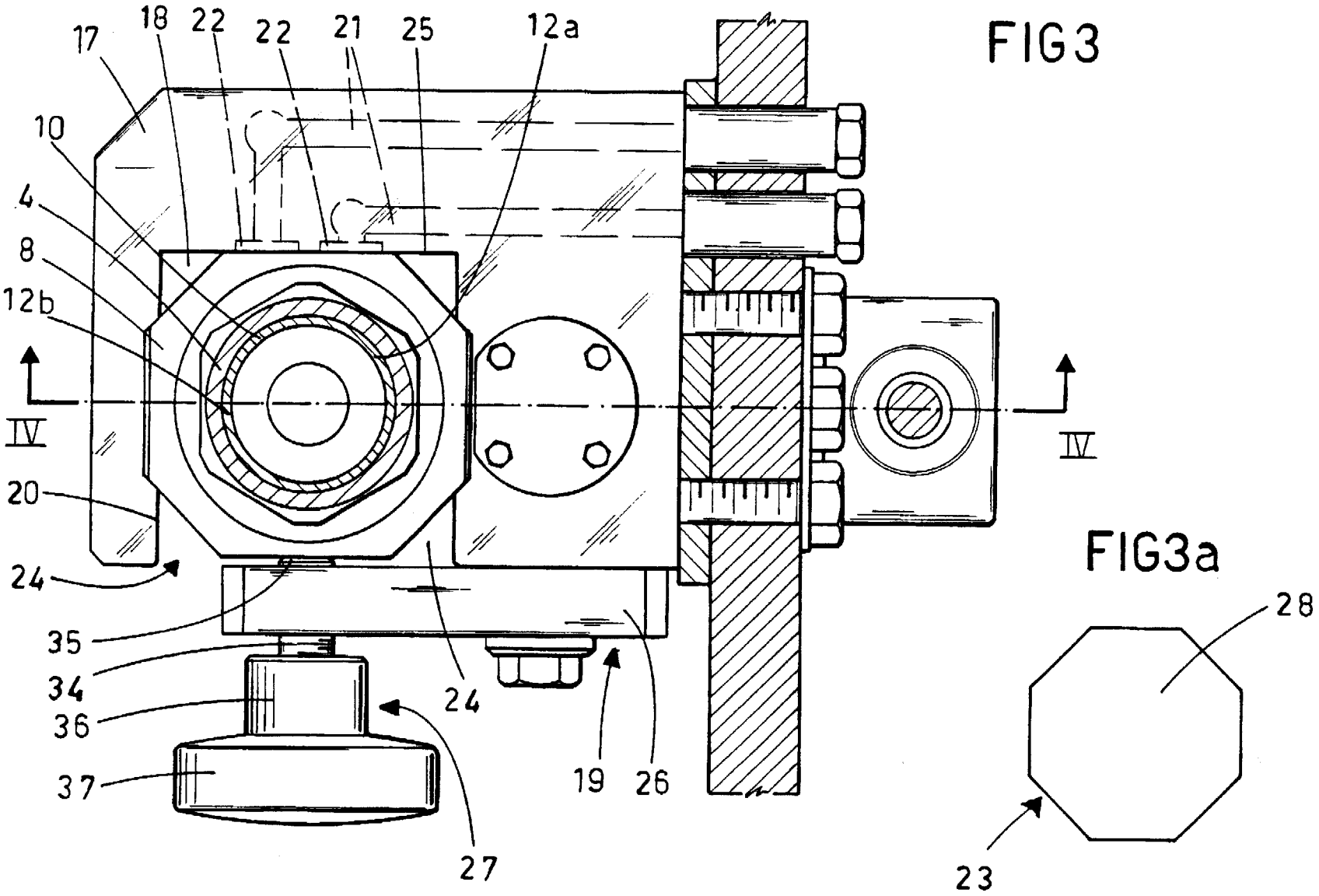
FIG. 3 shows an overall plan view, on a larger scale, of a detail of the invention shown with some parts removed so that others can be seen more clearly.
FIG. 3*a* shows a plan view of a detail of the invention.

As can be seen from FIGS. 3 and 4, the tool-carrying devices (1) in the description are preferably removably mounted on the vertical structure (16) of the wire-drawing machine (29). For this purpose, the wire-drawing machine (29) is in fact provided with fixing brackets (17) which have a seat (18) for removable mounting of the support (8) for the tubular body (4).

Said brackets (17) are equipped moreover with rapid locking and release means (19) which enable the support (8) for the tubular body (4) to be fixed stably in the seat (18) when the die (3) is in the operative condition, but allowing it to be removed from the wire-drawing machine (29) in the non-operative condition.

Moreover the bracket (17) is provided with ducts (21) for conveying fluid intended to supply the chamber (11) for cooling the support (8) of the tubular body (4).

The seat (18), as can be seen from FIG. 4, comprises a horizontal guide (20) on which the die-carrier (8) is slidably mounted so as to be movable, transversely with respect to the metal wire (2), from a non-operative position into an operative position in which the support (8) for the tubular body (4) is associated with the seat (18) of the fixing bracket (17).

The guide (20) has a first open end (24) for engaging and inserting the die-carrier (8) onto the bracket (17) and a second closed end (25) opposite the former. At the closed end (25), the seat (18) has sections (22) for the attachment of fluid ducts (21) which supply the chamber (11) cooling the support (8).

The position of said attachment sections (22) on the seat (18) is such that, when the support (8) for the tubular body (4) is mounted in the seat (18), the fluid connections between the attachment sections mounted on the support (8) and those provided on the tubular body (4) are automatically activated.

The aforementioned locking and release means (19) comprise an element (26) hinged on the bracket (17) at the open end (24) of the guide (20). This hinged element (26) is movable from an end position, in which the support (8) for the tubular body (4) is able to move freely inside the guide (20), into an end position in which the support (8) for the tubular body (4) is pressed up against the closed end (25) of the guide (20).

In order to render even more effective in particular the fluid tightness in the region of the attachment sections (22) of the ducts (21), the bracket (17) also comprises a thrust member (27) which is supported by the hinged element (26) and can be associated with the support (8) for the tubular body (4) so as to press it against the second closed end, forming there a sealed connection of said attachment sections (22).

As can be seen from FIG. 3, a simple design of the thrust member (27) may consist in a threaded rod (34) which is helically coupled with the tubular element (26) and having an active end (35) which can be engaged on the support (8) for the tubular body (4) and an opposite end (36) provided with a knob (37) for operating the thrust member (27).

The fixing support (17) described above advantageously enables the entire tool-carrying device (1) to be removed from the wire-drawing machine (29) so that all its parts can be accessed with great ease by the operators when checking the operation of the wire-drawing machine (29); or also it allows one or more working sections (30) to be removed from the wire-drawing machine in the event that the drawing operation can be performed completely only with a small number of working sections. However, carrying out such operations could result in the possibility of leakage of cooling fluid from the ducts (21) of the bracket (17). To avoid this drawback, the bracket (17) is provided with means (23) for intercepting the cooling fluid which can be formed in many functionally equivalent ways. A simple constructional form of these intercepting means (23) consists in a steel stopper (28) shaped in an identical manner to the support (8) for the tubular body (4) so that, like the latter, it complements the seat (18) of the bracket (17), in place of the support (8) for the tubular body (4) itself, intercepting the cooling fluid supply ducts (21) when the tool-carrying device (1) is in the non-operative condition.

The invention thus conceived may be subject to numerous modifications and variations, all of which fall within the scope of the inventive idea.

Moreover, all the details may be replaced by technically equivalent elements.

In practice, modifications and/or improvements are obviously possible, provided that they fall within the scope of the following claims.

What is claimed:

1. Wire-drawing machine for metal wire with dry lubrication, comprising at least one tool-carrying device provided with:

a tubular body having a cavity for containing and fixing at least one die, extending from an entry end to an exit end for the metal wire inside the tubular body;

a support for the tubular body, on which the tubular body is rotatably mounted so as to rotate upon operation of associated actuator means so as to cause rotation of the die, rendering uniform the wear thereof caused by the metal wire, said support for the tubular body being provided with a fluid cooling chamber for the die;

a container for powdery lubricant associated with the support for the tubular body so as to lubricate the metal wire before it enters the die, wherein said lubricating container is arranged above the support for the tubular body and is connected to the tubular body so as to rotate together therewith about the metal wire, imparting to the powdery lubricant contained therein a helical movement towards the die.

2. Wire-drawing machine as claimed in claim 1, wherein the lubricant container contains a stirrer immersed in the lubricant itself.

3. Wire-drawing machine as claimed in claim 1, wherein the container and the tubular body are formed such that they are removably associated with one another.

4. Wire-drawing machine as claimed in claim 1, wherein the container has the form of a solid of revolution symmetrical with respect to the metal wire.

5. Wire-drawing machine as claimed in claim 1, comprising a vertical structure on which at least two said devices are mounted so as to be positioned above one another with vertical alignment of the respective containers and the associated supports for the tubular body.

6. Wire-drawing machine as claimed in claim 3, wherein the container comprises at least two parts which are assembled with one another so as to form together a container which is associated with the tubular body while the metal wire is inserted inside the die.

7. Wire-drawing machine as claimed in claim 3, wherein the container has a shaped end for engagement in a corresponding cavity of the tubular body.

8. Wire-drawing machine as claimed in claim 4, wherein the container is cup-shaped.

9. Wire-drawing machine as claimed in claim 8, wherein the container has a section for loading the lubricant, which is open at the top.

10. Wire-drawing machine as claimed in claim 5, wherein said devices are removably mounted on said vertical structure.

11. Wire-drawing machine as claimed in claim 5, comprising a bracket for fixing said said devices on the vertical structure, having a seat for removably mounting the support for the tubular body, said bracket comprising rapid locking and release means for stably fixing, inside the said seat, the support for the tubular body to the said fixing bracket when the die is in the operative condition, but allowing removal thereof in the non-operative condition.

12. Wire-drawing machine as claimed in claim 11, wherein the fixing bracket is provided with ducts supplying cooling fluid for the support for the tubular body, said ducts being provided with attachment sections formed on the seat for removable mounting of the support for the tubular body, such that they are associated with corresponding attachment sections provided on the said support for the tubular body when the support for the tubular body is mounted in the said seat.

13. Wire-drawing machine as claimed in claim 11, wherein the seat for removable mounting of the support for the tubular body comprises a horizontal guide on which the said seat for the tubular body is slidably mounted so as to be movable, transversely with respect to the metal wire, from a non-operative position to an operative position in which the support for the tubular body is associated with the seat of the fixing bracket.

14. Wire-drawing machine as claimed in claim 12, comprising a stopper device for intercepting the cooling fluid and obstructing the cooling fluid ducts which is activable in the non-operative condition of said support for the tubular body.

15. Wire-drawing machine as claimed in claim 13, wherein the guide has a first open end for engaging a die-carrier on the fixing bracket and a second closed end provided with attachment sections for the support for the tubular body, said locking and release means comprising at least one element, hinged on the fixing bracket at the said open end of the guide, said hinged element being movable from an end position in which the support for the tubular body is able to move freely inside the guide, to a end position in which the support for the tubular body is pressed up against the closed end of the guide.

16. Wire-drawing machine as claimed in claim 14, wherein the stopper device for intercepting the cooling fluid and obstructing the cooling fluid ducts comprises a stopper which is associable with the seat of the fixing bracket in place of the support for the tubular body so as to intercept the ducts thereof supplying cooling fluid.

17. Wire-drawing machine as claimed in claim 15, wherein the fixing bracket comprises a thrust member which is supported by said hinged element and is associable with said support for the tubular body so as to press it against said second closed end, forming there a sealed connection of said attachment sections.

18. Wire-drawing machine as claimed in claim 17, wherein the thrust member comprises a threaded rod helically coupled with the hinged element and having an active end which can be engaged on the support for the tubular body and an opposite end provided with a knob for operation of the thrust member.

* * * * *